US008096094B2

(12) United States Patent
Mees

(10) Patent No.: US 8,096,094 B2
(45) Date of Patent: Jan. 17, 2012

(54) METHODS FOR FINISHING AN EDGE OF AN INSULATED CONCRETE FORM (ICF) WALL

(75) Inventor: Geoffrey Claude Mees, Mehlville, MO (US)

(73) Assignee: All-Terior Systems, LLC, St. Louis, MO (US)

( * ) Notice: Subject to any disclaimer, the term of this patent is extended or adjusted under 35 U.S.C. 154(b) by 0 days.

(21) Appl. No.: 12/608,800

(22) Filed: Oct. 29, 2009

(65) Prior Publication Data

US 2010/0043343 A1 Feb. 25, 2010

Related U.S. Application Data

(62) Division of application No. 11/680,409, filed on Feb. 28, 2007.

(60) Provisional application No. 60/767,043, filed on Feb. 28, 2006.

(51) Int. Cl.
*E04B 1/04* (2006.01)

(52) U.S. Cl. ..... 52/742.14; 52/742.15; 52/212

(58) Field of Classification Search ..... 52/210–217, 52/204.1, 204.5, 204.54, 300, 309.11, 309.12, 52/309.17, 426–431, 383, 565, 699, 717.01, 52/718.01, 718.07, 742.14, 745.15, 745.16
See application file for complete search history.

(56) References Cited

U.S. PATENT DOCUMENTS 1,606,201 A * 11/1926 Willis ..... 52/714
1,856,150 A * 5/1932 Baum ..... 52/216
2,101,349 A 12/1937 Sharp
2,742,117 A 4/1956 Tolman
3,109,260 A * 11/1963 De Cesare ..... 52/300
3,269,068 A 8/1966 King
3,862,531 A * 1/1975 Attaway et al. ..... 52/300
4,223,494 A * 9/1980 Wendt ..... 52/211
4,445,264 A 5/1984 Banerian
4,813,204 A 3/1989 Rentschler
4,878,325 A 11/1989 Van Tuyl et al.
4,924,641 A * 5/1990 Gibbar, Jr. ..... 52/204.1
5,155,956 A * 10/1992 Norment et al. ..... 52/217
5,233,802 A * 8/1993 Rogers ..... 52/212
5,465,538 A * 11/1995 Powers, Jr. ..... 52/204.2
5,711,120 A 1/1998 Karpen
5,729,942 A * 3/1998 Moore, Jr. ..... 52/437
5,746,033 A 5/1998 Chuang
5,746,120 A 5/1998 Jonsson (Continued)

OTHER PUBLICATIONS

International Search Report completed on May 21, 2008 and mailed on Jul. 30, 2008.

(Continued)

*Primary Examiner* — Robert Canfield
*Assistant Examiner* — Christine T Cajilig
(74) *Attorney, Agent, or Firm* — Polster, Lieder, Woodruff & Lucchesi, LC

(57) ABSTRACT

A method for finishing an edge of an insulating concrete form wall constructed from insulating concrete form blocks having a cavity including covering a top surface of a side panel and a top portion of an exterior surface with an elongated member having two surface portions coupled together with an intermediate portion positioned between the two surface portions the intermediate portion being dimensioned and positioned for enclosing an end of the side panel and a portion of an opening to the cavity and attaching a plurality of wire ties positioned along the elongated member between the elongated member and rebar members positioned within the cavity, said coupling devices being attached before, during and after concrete being received within the cavity.

23 Claims, 3 Drawing Sheets

U.S. PATENT DOCUMENTS

| | | | | |
|---|---|---|---|---|
| 6,070,375 | A | 6/2000 | Anderson et al. | |
| 6,401,406 | B1 | 6/2002 | Komara | |
| 6,453,620 | B1 * | 9/2002 | Williams et al. | 52/2.15 |
| 6,530,185 | B1 * | 3/2003 | Scott et al. | 52/215 |
| 6,550,193 | B2 | 4/2003 | Potts | |
| 7,223,044 | B2 | 5/2007 | Quintile | |
| 2004/0231263 | A1 * | 11/2004 | McKay | 52/426 |
| 2006/0174588 | A1 * | 8/2006 | Anderson et al. | 52/786.1 |
| 2006/0260239 | A1 * | 11/2006 | Boese et al. | 52/426 |

OTHER PUBLICATIONS

Mexican Official Action dated Dec. 29, 2010.

* cited by examiner

METHODS FOR FINISHING AN EDGE OF AN INSULATED CONCRETE FORM (ICF) WALL

CROSS-REFERENCE TO RELATED APPLICATIONS

This application is a divisional of Divisional Application of U.S. patent application Ser. No. 11/680,409, filed on Feb. 28, 2007, which claims the benefit of U.S. Provisional Application No. 60/767,043, filed on Feb. 28, 2006. The disclosure of the above application is incorporated herein by reference.

FIELD

The present disclosure relates to methods of building structures, more specifically, to methods associated with finishing of an edge of an insulating concrete form (ICF) construction.

BACKGROUND

The statements in this section merely provide background information related to the present disclosure and may not constitute prior art.

As is known in the construction art, modern building construction often includes construction of concrete walls with insulated concrete forms (ICF's) that are composed of a foam insulating material that form permanent concrete form walls. ICF construction sandwiches a heavy, high-strength reinforced concrete between two layers of a light, high-insulation foam. This combination creates a wall with an unusually good combination of desirable properties: air tightness, strength, sound attenuation, insulation, and mass.

These ICF walls are constructed by placing separate ICF building blocks on each other. Rebar is placed within a cavity formed by the ICF blocks. Concrete is then poured and the walls are formed with the ICF blocks being left in place, even after the concrete hardens. The concrete wall so formed can include foundation walls and other building walls. Generally, further insulation is not necessary. Such walls can be externally finished such as with veneers, stucco, gypsum boards, and brick on the interior and exterior of the wall as required. The ICF blocks are typically made with two opposing expanded polystyrene side panels that are arranged in spaced parallel relationship with their inner surfaces facing each other to form a cavity therein. Plastic or metal bridging members can be molded into the side panels to hold them together to form the blocks and to hold them against the forces applied by the poured concrete within the cavity. Typically, an end plate is molded within each side panel as an internal "stud" for attachment of finishing materials. The bridges are typically attached to these end plates for structural support during the pouring of the concrete and for anchoring the endplate into the cured concrete. Re-bar is often placed horizontally and vertically within the cavities of the ICF blocks before the concrete is poured. The purpose of using re-bar is to hold the concrete in compression to provided added strength.

As these ICF blocks are stacked to form an ICF form wall, it is often necessary to form openings for doors, windows and system bypassing. These openings are often formed with block-out systems known as "bucks" that provide the openings as required within the ICF form wall before and after the concrete is poured. As with traditional construction, bucks have been utilized to provide such a block-out opening in the wall. Many of these conventional bucks are removable once the concrete has hardened, similar to the wood forms. These are often referred to as "reusable bucks".

These bucks are typically built as wooden framed bucks that provide the opening in the wall. These can be removable or can be left in place similar to the ICF form blocks. If left in place after the poured concrete has cured, this wooden frame of the buck provides a fastening surface for the window or door and its finishing trim. The buck typically retains the concrete and also provides a point of attachment for interior and exterior finishes around the edge of the openings. In order to keep the wood frame properly aligned in the opening within the stacked wall forms, one or more temporary braces can also be used. These typically help to provide alignment of the wall forms with the wood frame. The buck typically requires supplemental bracing inside its frame to prevent deflection of the wood members under pressure from the poured concrete. This is usually accomplished by temporarily placing a brace between one or more side of the buck opening.

When the buck frame is to be left in the wall, it is typically secured to the concrete by one or more fasteners, such as nails or anchor bolts. These are positioned prior to the pouring of the concrete and are secured to the frame and left hanging between the side panels of the ICF system where the concrete will be poured. The subsequent pouring of wet concrete into the cavity causes the wet concrete to flow around the fasteners and partially secure the buck frame in place once the concrete has hardened.

Such bucks have been traditionally constructed of wood and plastic. However, these bucks have demonstrated a variety of problems. For instance, wood bucks are known to change dimensions over time as a result of variations in humidity, temperature, and pressure, such as during the actual construction process. Plastic bucks have been shown to deform similarly especially over time. Additionally, these plastic and wood bucks are not configured to endure substantial stress and do not offer strong bonds to the wall and as such can become easily dislodged from the wall.

As a result of the foregoing problems and disadvantages, there is a need in building construction for a more efficient, cost-effective and reliable methods for forming openings and finishing edges in poured concrete walls made with permanent concrete forms such as insulated concrete forms (ICFs).

SUMMARY

The inventors hereof have succeeded at designing methods for finishing edges during the construction of insulated concrete form (ICF) walls. These methods can, in some embodiments, provide for improved ICF construction that includes integrated structural support for roofing and windows and doors, improved edge finishes, and reduced construction costs, among other benefits and improvements.

According to one aspect, a method for finishing an edge of an insulating concrete form wall constructed from an insulating concrete form block having two opposing side panels defining a cavity there between, the method including enclosing an end of one of the insulating concrete form side panels and at least a portion of the cavity with an elongated body having two surface portions coupled together with an intermediate portion positioned between the two surface portions in a substantially parallel position. The intermediate portion being dimensioned for enclosing an end of the side panel and a portion of an opening to the cavity and wherein one of the two parallel surface portions is dimensioned for covering a portion of the side panel proximate to the end. The method also includes securing the elongated body to an internal structural support member within the cavity with a plurality of coupling devices attached between retention members positioned along the elongated body and the internal structural support member. The method further includes pouring concrete into the cavity and encapsulating the coupling devices and the structural support member within the concrete.

According to another aspect, a method for finishing a top edge of an insulating concrete form wall constructed from an insulating concrete form block having two opposing side panels defining a cavity there between, the method including covering a top surface of a side panel and a top portion of an exterior surface of the side panel that is proximate to the top surface with an elongated member having two surface portions coupled together with an intermediate portion positioned between the two surface portions in a substantially parallel position. The intermediate portion being dimensioned and positioned for enclosing an end of the side panel and a portion of an opening to the cavity and wherein one of the two parallel surface portions is dimensioned and positioned for covering a portion of the side panel proximate to the end. The method also includes attaching a plurality of coupling devices positioned along the elongated member between the elongated member and one or more internal structural support members positioned within the cavity, said coupling devices being attached before, during and after concrete being received within the cavity.

According to yet another aspect, a method of finishing an edge of an opening in an insulating concrete form wall constructed from an insulating concrete form block having two opposing side panels defining a cavity there between, the method including covering an exposed end of a first side panel and a first portion of the cavity with a first elongated member having two surface portions coupled together with an intermediate portion positioned between the two surface portions in a substantially parallel position. The intermediate portion dimensioned for enclosing an end of the first side panel and a portion of an opening to the cavity and wherein one of the two parallel surface portions is dimensioned for covering a portion of the first side panel proximate to the end. The method also includes covering an exposed end of a second side panel and a second portion of the cavity with a second elongated member having two surface portions coupled together with an intermediate portion positioned between the two surface portions in a substantially parallel position. The intermediate portion dimensioned for enclosing an end of the second side panel and a portion of an opening to the cavity and wherein one of the two parallel surface portions is dimensioned for covering a portion of the second side panel proximate to the end. The method also includes fastening the second elongated member to the first elongated member. The method further includes attaching a plurality of coupling devices between retention members positioned along the first elongated member and a structural support member positioned within the cavity and between retention members positioned along the second elongated member and a structural support member positioned within the cavity, wherein the coupling devices are attached before, during and after receiving of concrete into the cavity.

In accordance with another aspect, a method includes covering an exposed end of a first side panel and a first portion of the cavity with a first elongated member and covering an exposed end of a second side panel and a second portion of the cavity with a second elongated member. The method also includes fastening the second elongated member to the first elongated member and attaching a plurality of coupling devices between retention members of the first elongated member and a structural support member positioned within the cavity and between retention members of the second elongated member and a structural support member positioned within the cavity.

Further aspects of the present disclosure will be in part apparent and in part pointed out below. It should be understood that various aspects of the disclosure may be implemented individually or in combination with one another. It should also be understood that the detailed description and drawings, while indicating certain exemplary embodiments, are intended for purposes of illustration only and should not be construed as limiting the scope of the disclosure.

BRIEF DESCRIPTION OF THE DRAWINGS

It should be understood that throughout the drawings, corresponding reference numerals indicate like or corresponding parts and features.

DETAILED DESCRIPTION

Figure 1:
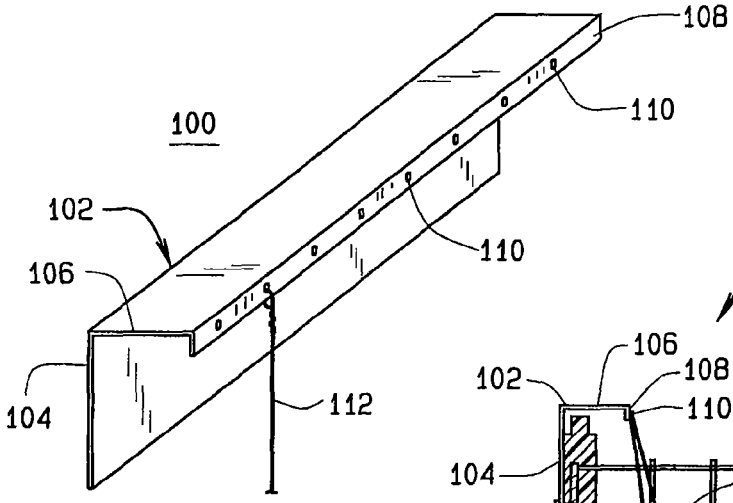
FIG. 1 is top perspective view of an edge finishing assembly for a top edge of an insulating concrete form (ICF) wall according to one exemplary embodiment.

The following description is merely exemplary in nature and is not intended to limit the present disclosure or the disclosure's applications or uses.

In some embodiments, an assembly for finishing an edge of an insulating concrete form wall includes at least one elongated body having two surface portions coupled together with an intermediate portion positioned between the two surface portions in a substantially parallel position. The intermediate portion is dimensioned for enclosing an end of a side panel of an insulating concrete form block and a portion of the concrete within the wall. At least one of the two parallel surface portions is dimensioned for covering a portion of the side panel proximate to the end. The elongated body can be made of any material including metal or non-metals such as carbon fiber and other synthetics. The elongated body can be cut with standard construction tools and methods into any length.

A plurality of retention members are positioned along the at least one elongated body. Each retention member is adapted for receiving and securing a coupling device for coupling to an internal structural support member within the concrete of the wall. The retention members can be formed integral to the elongated body, such as integrally formed holes, tabs, loops, extension wings or portions, or can be formed as tabs or other members on one or more retention strips that are fixedly attached to a surface of the elongated body, such as by welding or adhesion, by way of examples. The retention members can be configured for receiving and securing the coupling devices, such as a tab or hook or other feature for receiving and securing a wire tie coupling device. In some embodiments, the retention members, or a strip containing one or more retention members, can be integrally formed with a coupling device that is configured for attaching to and securing with a structural member within a wall.

As generally described herein, a structural member within a wall includes any component providing structural support, including during construction prior to and during the pouring of concrete into the ICF wall cavity and/or following the pouring and curing of the concrete. For example, this can include rebar or wire or other metal bridges or wire placed in the cavity. The securing of the retention members with the securing devices to a structural member provides in some embodiments securing the assembly into the opening or along the edge to enclose the opening of the cavity to enclose the concrete when poured. This can also include providing structural strength and support for the assembly following the curing of the concrete including a structural tie between the assembly and the embedded structural members within the cured concrete. For example, a top cap having an assembly as described herein will have a strong structural tie into the concrete and structural members within the concrete for providing a secure attachment of a roof. Similarly, an edge defining an end or opening, a window frame, a door frame, a window jamb or a door jamb having a structural tie through the retention members and coupling devices to the structural members within cured concrete can provide for strengthened edge finishing including increased pull strength for inhibiting the displacement of the edge finishing from the ICF wall or roof/ceiling.

Figure 2A:
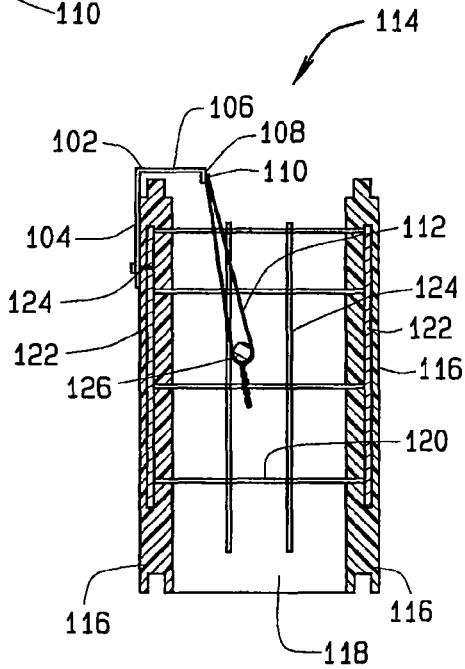
FIGS. 2A and 2B are side cross-sectional views of a top of an ICF wall illustrating the installed edge finishing assembly of FIG. 1 with FIG. 2A showing a single assembly installed and FIG. 2B showing two assemblies installed according to two exemplary embodiments.
Figure 2B:
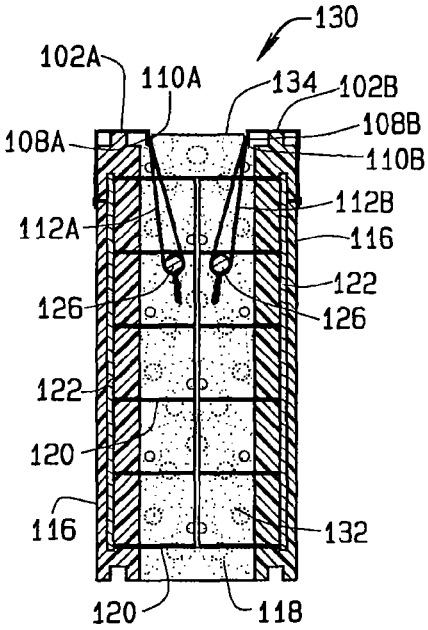

In some embodiments, there is a single elongated body, as shown in FIG. 1 by way of example, with a first substantially parallel surface portion that is a first vertical surface portion and the other substantially parallel surface portion that is a second vertical surface portion. Assembly 100 includes an elongated body 102 with two substantially parallel surface portions 104 and 110 and an intermediate portion 106 can be configured for covering a top edge of the insulating concrete form wall so as to provide a cap or flashing as shown in FIGS. 2A and 2B. The retention members 110 are formed along the outer surface of the second surface 108 as hooks or tabs for receiving and securing coupling members 112 shown, by way of example, as a wire tie looped around and/or twisted to the retention members 110 and also tied or otherwise secured to a structural feature or element within the cavity 118.

An ICF wall 114 is shown under construction in FIG. 2A. The ICF wall 114 includes two sidewalls 116 defining a cavity 118. Bridges 120 can also provide the proper distance between the sidewalls 116 for providing a proper cavity width. A plurality of studs 122 or stud support members can be embedded within the side walls 116 and can be coupled to the bridges for providing structural support to the bridges 120 and for making structural attachment from the exterior of the side wall 116. Additionally, after the concrete is poured and cured in the cavity, the bridges provide structural support to the studs 122 to support attachments thereto. The bridges 120 can include vertical members 124 that are positioned within the cavity 118. Structural support member 126, such as rebar, welded wire mesh, by way of examples, can also be placed in the cavity and can be coupled to the bridges 120 and/or vertical members 124 to provide additional strength or compressive force to the concrete once cured.

As shown in FIG. 2A, an elongated body 102 can be positioned to cover a top portion of the sidewall 116 and can also cover a portion of the cavity 118 in which concrete will be poured. The elongated body 102 can be secured by the concrete and/or by the coupling devices 112 so that the body 102 protects the top of the sidewall 116. The elongated body 102 can also be attached along the outer surface of the elongated surface portion 104 to an outer surface of the sidewall 116 with a fastener 128, such a screw that can be screwed into the side panel and secured into the embedded stud 122. As shown, the coupling device 112 is attached to the retention member 110 for securing the retention member 110, and therefore the elongated body 102 and assembly 100, to a structural member, such as to the rebar 126 by way of example. In this manner, the secured elongated body 102 can act as a structural cap for engaging a roof or other construction feature, so that the wall 114 can meet particular construction standards including hurricane, earthquake, and tornado building construction objectives, as well as providing protection to the vulnerable top of the ICF sidewalls 116.

Similarly, an ICF wall 130, as shown in FIG. 2B can include two assemblies with two elongated bodies 102A and 102B, each installed on wall 130 to protect a different one of the two sidewalls 116. As shown here, concrete 132 has been poured into the cavity 118 and has cured to form the concrete portion of the wall 130. The concrete is cured to enclose and secure the bridges 120, the rebar 126, the vertical members 124, the coupling devices 112 and can also engage and secure the second surfaces 108A and 108B of the elongated members 102A and 102B. As noted above, the elongated bodies 102A and 102B become structurally secured by the wall and provide a top flashing that has structural integrity while also protecting the tops of the sidewalls 116.

Figure 3:
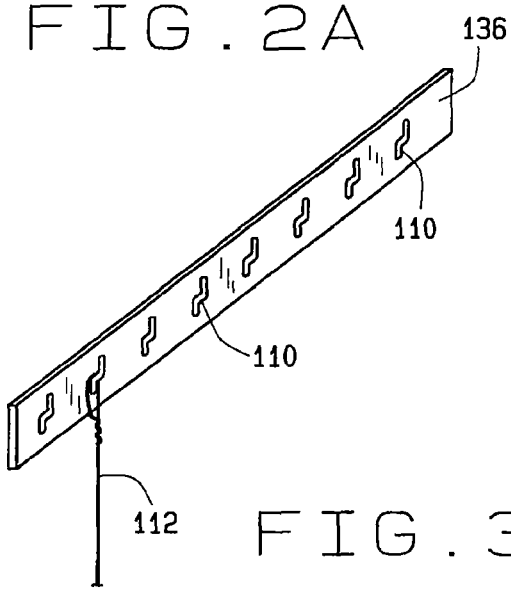
FIG. 3 is a bottom perspective view of a retainer element having a plurality of retention tabs according to another exemplary embodiment

While FIG. 1 illustrates retention members 110 that are integrally formed into the outer portion of second surface 108 of elongated body 102, such retention members 110 can also be formed on a strip 136 or auxiliary body as shown in FIG. 3, or can be formed as an extension member extending from the elongated body for coupling to the coupling devices or that integrate the coupling devices into the retention member 110 that fixedly attach directly to the structural member within the cavity 118. As illustrated in FIGS. 1 and 3, the retention members can be formed to be uniformly spaced along the strip 136. Thereafter, the strip 136 is bonded, welded, or otherwise affixed to the surface of the elongated body.

Figure 4:
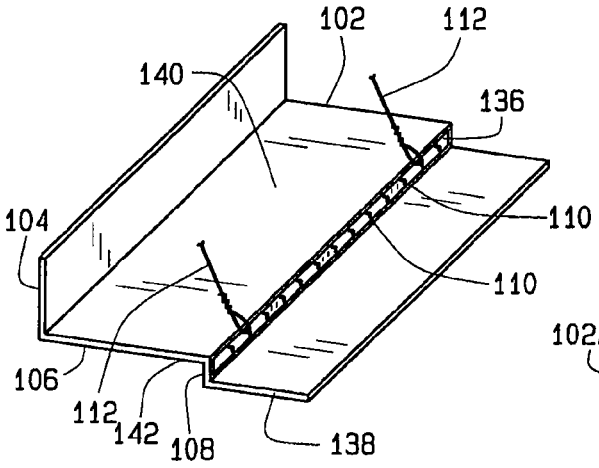
FIG. 4 is a perspective view of the inner surfaces of an end component of an edge finishing assembly for an opening in an ICF wall according to another exemplary embodiment.
Figure 5:
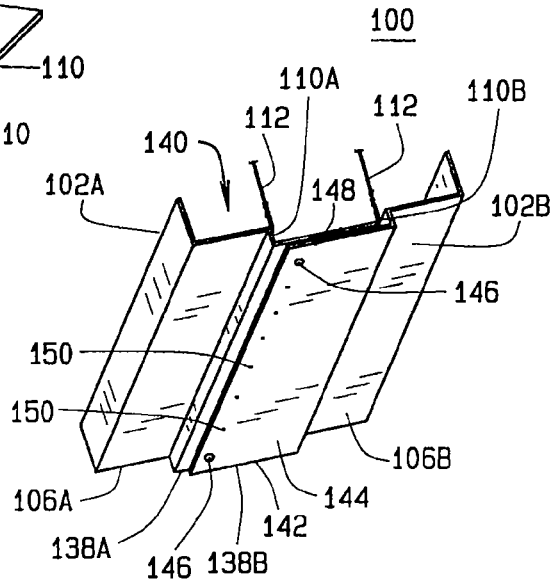
FIG. 5 is a perspective view of the outer surface of an edge finishing assembly utilizing two end components of FIG. 4 for the edges of an opening in an ICF wall according to one exemplary embodiment.

Referring now to FIGS. 4 and 5, in other embodiments, a single elongated body 102 is illustrated in FIG. 4, and an assembly 100 having two elongated bodies 102 from FIG. 4 is illustrated in FIG. 5. The elongated body 102 includes two surface portions 104 and 108 and intermediate portion 106 coupling the two elongated surface portions 104 and 108 together, and an elongated end portion 138. A retention member strip 136 is fixedly attached, in this example, to intermediate portion 106 for providing the retention members 110. As illustrated, the retention members 110 are positioned on an inner portion 140 of the elongated body 140 that is opposing the outer portion 142. The inner portion 140 is positioned towards the cavity 118 for attaching the coupling devices 112 to a structural support member 126 positioned in the cavity 118.

As shown in FIG. 5, a first elongated body 102A is positioned in an opposing position to a second elongated body 102B such that the two elongated end portions 138A and 138B are facing in opposite directions and are positioned such that one is overlapping the other to form an overlap section 144. Each elongated end portion 138A and 138B can be dimensioned for a fixed distance of overlap or for a variable distance of overlap thereby providing a variable total width of the assembly 100. The two elongated end portions 138A and 138B can be coupled with fasteners 146, such as screws, welds, and adhesives, by way of example. Additionally, a seal 148 can be positioned between the two elongated end portions 138A and 138B, such as to provide a thermal or other seal at their point of overlap.

Each retention member 110A and 110B is positioned along the respective elongated body 102A and 102B facing towards the inner portion 140 such that the coupling devices 112 can be attached to the retention members 110A and 110B and to the structural members 126.

One or more of the end surface portions 138A and 138B can include a plurality of dimples 150 along the outer surface 142 for enabling the positioning and penetration of a screw or other fastener through the surface. Such fasteners 146 can be positioned along the elongated end surface portions 138A and 138B or any overlapping portion 144 as described herein to fixedly couple the overlapped end surfaces or portions to form the assembly 100.

Figure 6:
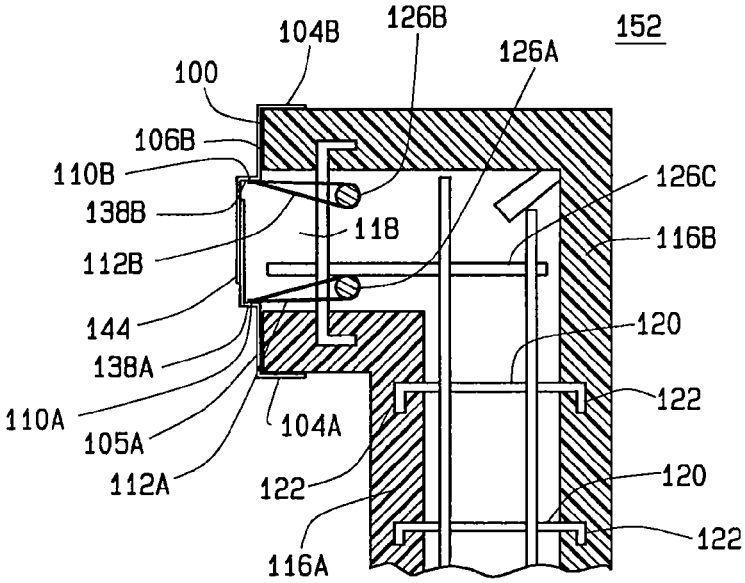
FIG. 6 is a top perspective view of a vertical edge of an opening in an ICF wall illustrating the placement of the edge finishing assembly of FIG. 5 according to another exemplary embodiment.

An ICF wall 152, as shown in FIG. 6, can be constructed using the assembly 100 of FIG. 5. The assembly 100 is positioned about the end of the wall 152 to enclose the cavity 118 and enclose the ends of the sidewalls 116A and 116B. In this example, the retention member 110A is coupled via coupling device 112A, such as a wire tie, to structural members 126A and 126C, wherein structural member 126A is a vertically disposed rebar and 126C is a horizontally disposed rebar. The retention member 110B is coupled via coupling device 112B to structural member 126C, a vertically disposed rebar. The assembly 100 covers the cavity 118 with the elongated bodies 102A and 10B covering the ends of both sidewalls 116A and 116B, with the elongated surface portions 104A and 104B covering the sides of the sidewalls 116A and 116B. In other embodiments, the coupling devices 112A and 112B could be coupled to other structural members 126 within the cavity, such as a structural bridge 120.

Figure 7:
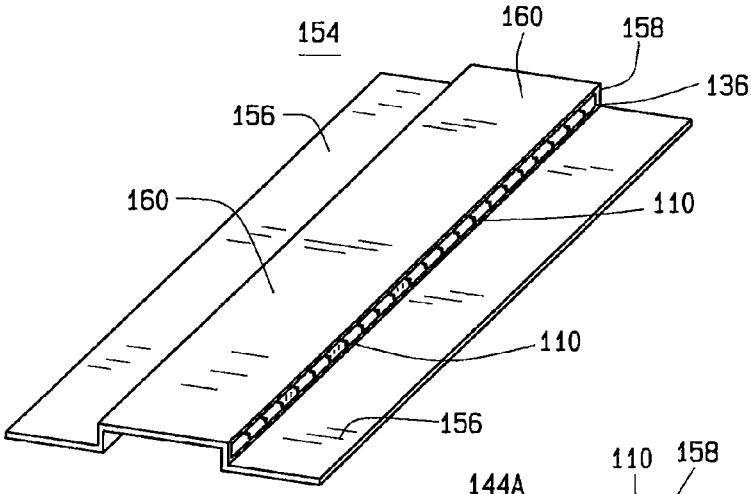
FIG. 7 is a perspective view of an inner surface of a coupling component for an edge finishing assembly according to another exemplary embodiment.
Figure 8:
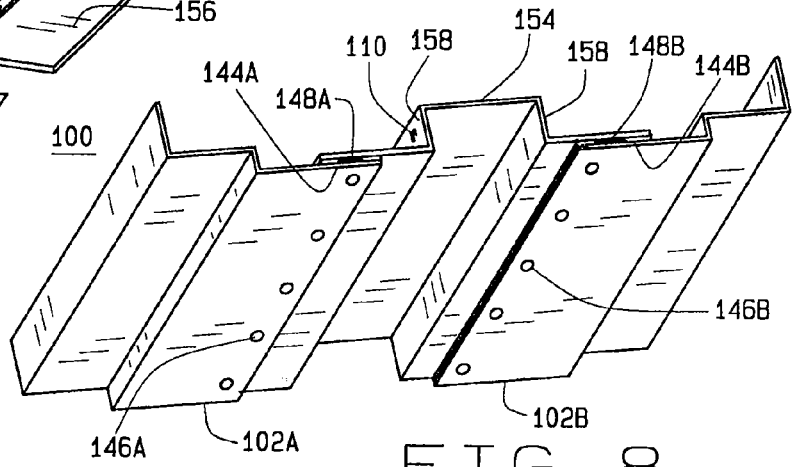
FIG. 8 is a top perspective view of the outer surface of an edge finishing assembly utilizing two end components of FIG. 4 and the coupling component of FIG. 7 according to yet another embodiment.
Figure 9:
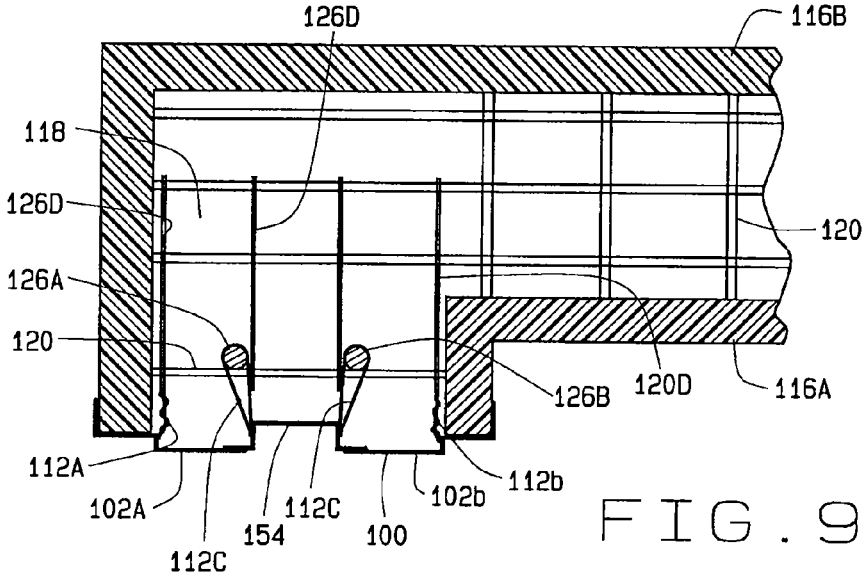
FIG. 9 is a top perspective view of a vertical edge of an opening in an ICF wall illustrating the placement of the edge finishing assembly of FIG. 8 according to still another exemplary embodiment.

In other embodiments, the width of the ICF wall can be greater than the combined widths of the two elongated bodies including the overlap. In such cases, a third elongated body can be positioned between the two elongated bodies 102A and 102B, as shown in FIGS. 7, 8, and 9. An expansion member 154 or expansion elongated body can be configured for coupling between the two end surface portions 138A and 138B to provide two additional overlapping portions 144A and 144B. The expansion member 154 can also include retention members 110 positioned along its body for securing the expansion member 154 to a structural element within the wall cavity. The expansion member 154 can also include two coupling surface portions 156, two offset surfaces 158 and a middle surface portion 160. The middle surface portion 160 can be substantially parallel to the two coupling surface portions 156. Such a middle surface portion 160 can be configured for receiving a traditional preassembled or customized door frame or construction wood or metal for building such a door frame or opening within the ICF wall or roof/ceiling. While the retention members 110 can be positioned on any surface of expansion member 154, in some embodiments, the retention members 110 are positioned along the two offset surfaces 158. Additionally, a retention member strip 136 can be attached to one of the surface of expansion member 154 for providing the retention members 100.

The assembly 100 of FIG. 8 illustrates the positioning of the expansion member 154 between the first elongated body 102A and 102B for forming two variable distance overlapping portions 144A and 144B. Additionally, in this example, two seals 148A and 14B are positioned between the two end portions 156 of the expansion member 154 and the elongated end portions 138A and 138B of the elongated members 102A and 102B. Fasteners 146A and 146B can be utilized for coupling the various members and forming assembly 100. In this example, the elongated body 102A is coupled to wire mesh 126D positioned in cavity 118 as a structural member and elongated body 102B is coupled to wire mesh 126D via coupling devices 112A and 112B, respectively.

Additionally the retention members 110 of the expansion member 154 can be coupled via coupling devices 112C to two separate rebar 126A and 12B positioned within the cavity 118 that serve as structural members 126. In this manner, the assembly 100 as illustrated in FIG. 9 can enclose both ends of sidewalls 116A and 116B and the opening to cavity 118. Additionally the assembly 100 can be secured via the retention members 110 and coupling devices 112 to one or more structural members 126, such as one or more of structural members 126A, 126B, and 126C, within the cavity such that the assembly is secured before, during and after pouring of the concrete into the cavity 118.

In one embodiment of practicing the present disclosure, a method for finishing an edge of an insulating concrete form wall constructed from an insulating concrete form block having two opposing side panels defining a cavity there between. The method includes enclosing an end of one of the insulating concrete form side panels and at least a portion of the cavity with an elongated body and securing the elongated body to an internal structural support member within the cavity with a plurality of coupling devices attached between retention members of the elongated body and the internal structural support member. Securing can include attaching wires on the retention members of the elongated body and twisting the wires about a rebar or other structural member positioned within the cavity. The method also includes pouring concrete into the cavity and encapsulating the coupling devices and the structural support member within the concrete.

As noted above, some assemblies can include two elongated bodies. In such embodiments, the method can include enclosing an end of a second insulating concrete form side panel and the remaining portion of the cavity with a second elongated body. The second elongated body can be attached to the first elongated body during this process. The second elongated body can also be attached or otherwise secured to an internal structural support member within the cavity by the coupling devices.

In other embodiments of practicing the disclosure, a method for finishing a top edge of an insulating concrete form wall constructed from an insulating concrete form block having two opposing side panels defining a cavity there between. The method includes covering a top surface of a side panel and a top portion of an exterior surface of the side panel that is proximate to the top surface with an elongated member and attaching a plurality of coupling devices between the elongated member and one or more internal structural support members positioned within the cavity. This can include covering a top surface of a second side panel and a second top portion of an exterior surface of the second side panel that is proximate to the top surface with a second elongated member and attaching a plurality of coupling devices between the second elongated member and one or more internal structural support members positioned within the cavity.

In another embodiment of practicing the disclosure, a method of finishing an edge of an opening in an insulating concrete form wall constructed from an insulating concrete form block having two opposing side panels defining a cavity there between. The method includes covering an exposed end of a first side panel and a first portion of the cavity with a first elongated member and covering an exposed end of a second side panel and a second portion of the cavity with a second elongated member. The method also includes fastening the second elongated member to the first elongated member and attaching a plurality of coupling devices between retention members of the first elongated member and a structural support member positioned within the cavity and between retention members of the second elongated member and a structural support member positioned within the cavity. This can include overlapping a portion of the first elongated member with a portion of the second elongated member and wherein fastening includes fastening the second elongated member to the first elongated member in the overlapping portion.

In some cases, an elongated expansion member can be coupled between the first elongated member and the second elongated member to provide a separation between the two and to expand the distance for covering deeper opening. In such cases, the first elongated member can cover first sidewall and a portion of the cavity, the elongated expansion member generally covers the cavity but can overlap and cover one or both of the sidewalls. The second elongated member covers the second sidewall and can also cover a portion of the cavity. Each of the elongated members and the expansion member can include retention members that are coupled using coupling devices to structural members within the cavity of the wall. Each of the coupled members can be coupled using fasteners or fastening means, including screws or adhesives such as in overlapping sections. Additionally, seals can be placed between the overlapping members to provide a thermal barrier.

As noted, while this disclosure generally describes application of the assembly to ICF walls and openings and edges of ICF walls, it should be clear that the assembly can also be used for opening and edges in roofs, floors, and ceilings and still be within the scope of this disclosure.

When describing elements or features and/or embodiments thereof, the articles "a", "an", "the", and "said" are intended to mean that there are one or more of the elements or features. The terms "comprising", "including", and "having" are intended to be inclusive and mean that there may be additional elements or features beyond those specifically described.

Those skilled in the art will recognize that various changes can be made to the exemplary embodiments and implementations described above without departing from the scope of the disclosure. Accordingly, all matter contained in the above description or shown in the accompanying drawings should be interpreted as illustrative and not in a limiting sense.

It is further to be understood that the processes or steps described herein are not to be construed as necessarily requiring their performance in the particular order discussed or illustrated. It is also to be understood that additional or alternative processes or steps may be employed.

What is claimed is:

1. A method for finishing an edge of an insulating concrete form wall constructed from an insulating concrete form block having two opposing side panels defining a cavity there between and containing one or more reinforcing bars (rebar) therein, the method comprising:

enclosing an end of one of the insulating concrete form side panels and at least a portion of an opening to the cavity, but less than the entire opening to the cavity, with an elongated body having two surface portions coupled together with an intermediate portion positioned between the two surface portions in a substantially parallel position, the intermediate portion dimensioned for enclosing an end of the side panel and a portion of the opening to the cavity and wherein a first of the two parallel surface portions is dimensioned for covering an exterior surface portion of the side panel proximate to the end;

securing the elongated body to at least one of the rebar within the cavity with a plurality of wire tie coupling devices attached between a plurality of protruding retention members on a surface of the elongated body and positioned longitudinally along the elongated body and the at least one of the rebar; and pouring concrete into the cavity and encapsulating the wire tie coupling devices and the at least one rebar within the concrete.

2. The method of claim 1 wherein enclosing includes enclosing a top of one of the side panels with a single elongated body and wherein enclosing includes positioning a second of the two parallel surface portions of the elongated body within a portion of the cavity and wherein securing includes securing the wire tie coupling devices to retention members positioned on the second parallel surface portion positioned within the portion of the cavity, and wherein pouring concrete includes pouring concrete into the cavity and about the second portion of the elongated body positioned within the cavity.

3. The method of claim 1 wherein securing includes attaching the wire ties on the retention members of the elongated body and twisting the wire ties about the at least one rebar positioned within the cavity.

4. The method of claim 1, further comprising enclosing an end of a second opposing insulating concrete form side panel and the remaining portion of the cavity with a second elongated body, the second elongated body being parallel to first elongated body;

fastening the second elongated body to the first elongated body about their elongated bodies; and securing the second elongated body to at least one of the rebar within the cavity with a plurality of wire ties attached between retention members of the second elongated body and the at least one rebar.

5. The method of claim 4 wherein enclosing with a second elongated body includes overlapping a portion of the first elongated body along a longitudinal length of a portion of the second elongated body, further comprising:

installing a seal between first elongated body and the second elongated body along the longitudinal overlapping portion, wherein the seal is configured to, at least in part, provide a thermal barrier between the first elongated member and the second elongated member.

6. The method of claim 1, wherein enclosing the end of one of the insulating concrete form side panels and at least a portion of the cavity with an elongated body is a first side panel, a first elongated body and a first portion of the opening of the cavity, further comprising:

enclosing an end of a second opposing insulating concrete form side panel and a second portion of the cavity with a second elongated body, the second elongated body being parallel to first elongated body, wherein the first and second portions of the opening is less than the entire opening;

securing the second elongated body to at least one of the rebar within the cavity with a plurality of wire ties attached between retention members of the second elongated body and the at least one rebar;

coupling an elongated expansion member to the first elongated body, enclosing a middle portion of the cavity with the elongated expansion member; fastening the second elongated body to the elongated expansion member that is coupled to the first elongated body; and attaching a plurality of wire tie coupling devices between retention members of the elongated expansion member and at least one rebar positioned within the cavity.

7. The method of claim 6 wherein coupling the elongated expansion member to the first elongated body includes overlapping a longitudinal portion of the elongated expansion member with a longitudinal portion of the first elongated body and wherein fastening the second elongated body to the elongated expansion member includes overlapping another portion of the elongated expansion member with a longitudinal portion of the second elongated body, further comprising installing seals between elongated expansion member and the first elongated body and the second elongated body in the longitudinal overlapping portions, wherein the seals are configured to, at least in part, provide a thermal barrier between the elongated expansion member and the overlapping portions of the first and second elongated bodies.

8. A method for finishing an edge of an insulating concrete form wall constructed from an insulating concrete form block having two opposing side panels defining a cavity there between and containing one or more reinforcing bars (rebar) therein, the method comprising:

covering a top surface of a side panel and a top portion of an exterior surface of the side panel that is proximate to the top surface with an elongated member having two surface portions coupled together with an intermediate portion positioned between the two surface portions in a substantially parallel position, the intermediate portion being dimensioned and positioned for enclosing an end of the side panel and a portion of an opening to the cavity proximate to the side panel, but less than the entire opening to the cavity and wherein one of the two parallel surface portions is dimensioned and positioned for covering a portion of the side panel proximate to the end; and attaching a plurality of wire tie coupling devices positioned along the elongated member between the elongated member and one or more of the rebar positioned within the cavity, said wire tie coupling devices being attached before, during and after concrete being received within the cavity, wherein attaching includes attaching the wire ties to retention members having protruding tabs formed longitudinally on the elongated member and attaching each of those wires to the rebar positioned within the cavity.

9. The method of claim 8, further comprising fastening an outer one of the two surface portions of the elongated member to the exterior surface of the side panel.

10. The method of claim 8, further comprising:

covering a top surface of a second opposing side panel, a second portion of the opening to the cavity proximate to the second side panel, and a second top portion of an exterior surface of the second side panel that is proximate to the top surface with a second elongated member, wherein the first and second portions of the opening to the cavity do not fully close the opening to the cavity; and attaching a plurality of wire tie coupling devices between the second elongated member and one or more of the rebar positioned within the cavity.

11. A method of finishing an edge of an opening in an insulating concrete form wall constructed from an insulating concrete form block having two opposing side panels defining a cavity there between and containing one or more reinforcing bars (rebar) therein, the method comprising:

covering an exposed end of a first side panel and a first portion of the cavity with a first elongated member having two surface portions coupled together with an intermediate portion positioned between the two surface portions in a substantially parallel position, the intermediate portion dimensioned for enclosing an end of the first side panel and a first portion of an opening to the cavity that is less than the entire opening to the cavity and wherein a first of the two parallel surface portions of the first elongated member is dimensioned for covering an exterior surface portion of the first side panel proximate to the end;

covering an exposed end of a second side panel and a second portion of the cavity with a second elongated member having two surface portions coupled together with an intermediate portion positioned between the two surface portions in a substantially parallel position, the intermediate portion dimensioned for enclosing an end of the second side panel and a second portion of the opening to the cavity and wherein a first of the two parallel surface portions of the second elongated member is dimensioned for covering an exterior surface portion of the second side panel proximate to the end;

fastening the second elongated member to the first elongated member; and attaching a plurality of wire tie coupling devices between first retention members positioned along the first elongated member and at least one rebar within the cavity and between second retention members positioned along the second elongated member and at least one rebar positioned within the cavity, wherein the wire tie coupling devices are attached before, during and after receiving of concrete into the cavity, wherein the retention members of the first and second elongated members include protruding tabs formed along a second of the two parallel surface portions of the first and second elongated members, the attaching including coupling the wires to the tabs and twisting the wire ties around the at least one rebar positioned within the cavity.

12. The method of claim 11 wherein covering the exposed end of the second side panel includes overlapping a longitudinal portion of the first elongated member with a longitudinal portion of the second elongated member and wherein fastening includes fastening the second elongated member to the first elongated member in the overlapping portion, and wherein enclosing the first and second portions of the opening encloses the entire opening of the cavity.

13. The method of claim 12, further comprising installing a seal between first elongated member and the second elongated member in the longitudinal overlapping portion, wherein the seal is configured to, at least in part, provide a thermal barrier between the first elongated member and the second elongated member.

14. The method of claim 11, further comprising pouring concrete into the cavity and securing the wire tie coupling devices and rebar within the cured concrete, wherein the first and second elongated members substantially enclosed the edge of the cavity at the opening and prevent the poured concrete from exiting the cavity through the opening.

15. The method of claim 11, further comprising:

coupling an elongated expansion member to the first elongated member, wherein covering the first portion of the opening to the cavity with the first elongated member includes covering a third portion of the opening to the cavity with the elongated expansion member, and wherein fastening the second elongated member to the first elongated member includes attaching the second elongated member to the elongated expansion member that is attached to the first elongated member; and attaching a plurality of wire tie coupling devices between retention members of the expansion member and at least one rebar positioned within the cavity.

16. The method of claim 15 wherein coupling includes overlapping a first portion of the elongated expansion member with a portion of the first elongated member and overlapping a second opposing portion of the elongated expansion member with a portion of the second elongated member, further comprising installing seals between the first portion of the elongated expansion member and the first elongated member and the second portion of the elongated expansion member and the second elongated member in the overlapping portions, wherein the seals are configured to, at least in part, provide a thermal barrier between the overlapping members.

17. The method of claim 1 wherein the retention members are integrally formed protruding tabs spaced apart along a retention strip fixedly mounted to an inner elongated surface of the elongated body, wherein securing includes attaching the wire tie coupling devices to a plurality of the protruding tabs along the retention strip and to the at least one rebar.

18. A method of finishing an edge of an opening in an insulating concrete form wall constructed from an insulating concrete form block having two opposing side panels defining a cavity there between and containing one or more reinforcing bars (rebar) therein, the method comprising:

covering an exposed end of a first side panel and a first portion of the cavity with a first elongated member having two surface portions coupled together with an intermediate portion positioned between the two surface portions in a substantially parallel position, the intermediate portion dimensioned for enclosing an end of the first side panel and a first portion of an opening to the cavity that is less than the entire opening to the cavity and wherein a first of the two parallel surface portions of the first elongated member is dimensioned for covering an exterior surface portion of the first side panel proximate to the end;

covering an exposed end of a second side panel and a second portion of the cavity with a second elongated member having two surface portions coupled together with an intermediate portion positioned between the two surface portions in a substantially parallel position, the intermediate portion dimensioned for enclosing an end of the second side panel and a second portion of the opening to the cavity and wherein a first of the two parallel surface portions of the second elongated member is dimensioned for covering an exterior surface portion of the second side panel proximate to the end;

fastening the second elongated member to the first elongated member; and attaching a plurality of wire tie coupling devices between first retention members positioned along the first elongated member and at least one rebar within the cavity and between second retention members positioned along the second elongated member and at least one rebar positioned within the cavity, wherein the wire tie coupling devices are attached before, during and after receiving of concrete into the cavity, wherein the first and second retention members are integrally formed protruding tabs spaced apart along first and second retention strips fixedly mounted to an inner elongated surface of the first and second elongated bodies, wherein attaching includes attaching a first plurality of wire tie coupling devices to a first plurality of the protruding tabs along the retention strip of the first elongated member and to the at least one rebar, and attaching a second plurality of wire tie coupling devices to a second plurality of the protruding tabs along the retention strip of the second elongated member and to the at least one rebar.

19. The method of claim 18 wherein covering the exposed end of the second side panel includes overlapping a longitudinal portion of the first elongated member with a longitudinal portion of the second elongated member and wherein fastening includes fastening the second elongated member to the first elongated member in the overlapping portion, and wherein enclosing the first and second portions of the opening encloses the entire opening of the cavity.

20. The method of claim 18, further comprising installing a seal between first elongated member and the second elongated member in the longitudinal overlapping portion, wherein the seal is configured to, at least in part, provide a thermal barrier between the first elongated member and the second elongated member.

21. The method of claim 18, further comprising pouring concrete into the cavity and securing the wire tie coupling devices and rebar within the cured concrete, wherein the first and second elongated members substantially enclosed the edge of the cavity at the opening and prevent the poured concrete from exiting the cavity through the opening.

22. The method of claim 18, further comprising:

coupling an elongated expansion member to the first elongated member, wherein covering the first portion of the opening to the cavity with the first elongated member includes covering a third portion of the opening to the cavity with the elongated expansion member, and wherein fastening the second elongated member to the first elongated member includes attaching the second elongated member to the elongated expansion member that is attached to the first elongated member; and attaching a plurality of wire tie coupling devices between retention members of the expansion member and at least one rebar positioned within the cavity.

23. The method of claim 22 wherein coupling includes overlapping a first portion of the elongated expansion member with a portion of the first elongated member and overlapping a second opposing portion of the elongated expansion member with a portion of the second elongated member, further comprising installing seals between the first portion of the elongated expansion member and the first elongated member and the second portion of the elongated expansion member and the second elongated member in the overlapping portions, wherein the seals are configured to, at least in part, provide a thermal barrier between the overlapping members.

* * * * *